United States Patent [19]

Nishimura et al.

[11] Patent Number: 4,726,332

[45] Date of Patent: Feb. 23, 1988

[54] VARIABLE VALVE MECHANISM FOR INTERNAL COMBUSTION ENGINES

[75] Inventors: Hirofumi Nishimura; Yasuyuki Morita, both of Hiroshima, Japan

[73] Assignee: Mazda Motor Corporation, Hiroshima, Japan

[21] Appl. No.: 855,434

[22] Filed: Apr. 24, 1986

[30] Foreign Application Priority Data

Apr. 26, 1985 [JP] Japan ..... 60-91563
Apr. 26, 1985 [JP] Japan ..... 60-91566

[51] Int. Cl.[4] ..... F01L 1/34
[52] U.S. Cl. ..... 123/90.16; 123/90.39
[58] Field of Search ..... 123/90.15, 90.16, 90.17, 123/90.21, 90.27, 90.39, 90.4, 90.45, 90.6, 198 F

[56] References Cited

U.S. PATENT DOCUMENTS 3,712,278 1/1973 Kuhn ..... 123/90.4
4,354,460 10/1982 Mae et al. ..... 123/90.39
4,448,156 5/1984 Henault ..... 123/90.17
4,556,025 12/1985 Mokita ..... 123/90.39
4,561,391 12/1985 Simko ..... 123/90.39
4,627,391 12/1986 Derringer ..... 123/198 F

FOREIGN PATENT DOCUMENTS 0052554 5/1982 European Pat. Off. .
2493915 5/1982 France .
0077519 6/1981 Japan ..... 123/90.39
57-182205 11/1982 Japan .
0162309 9/1984 Japan ..... 123/90.16
0085205 5/1985 Japan ..... 123/90.16
0240813 11/1985 Japan ..... 123/90.39

*Primary Examiner*—Charles J. Myhre
*Assistant Examiner*—David A. Okonsky
*Attorney, Agent, or Firm*—Fleit, Jacobson, Cohn & Price

[57] ABSTRACT

A variable valve mechanism for an engine including a first rocker arm engaged at one end with the valve tappet and at the other end with a low speed profile cam, and a second rocker arm engaged with a high speed profile cam. A locking device is provided on the second rocker arm to releasably lock the second rocker arm on the first rocker arm under a high speed engine operation.

17 Claims, 14 Drawing Figures

VARIABLE VALVE MECHANISM FOR INTERNAL COMBUSTION ENGINES

BACKGROUND OF THE INVENTION

1. FIELD OF THE INVENTION

The present invention relates to a valve operating mechanism for an internal combustion engine. More particularly, the present invention pertains to a variable valve mechanism wherein the lift and/or the valve opening period can be changed in accordance with the engine operating conditions.

2. Description of the Prior Art

In internal combustion engines, it has been well known that the overlap period between intake and exhaust valves be as small as possible under a low speed engine operation for the purpose of decreasing the suck back of the exhaust gas and the blow back of the intake mixture which may otherwise cause combustion instability and poor fuel economy. For the purpose it is advisable to make the valve lift and the valve open period as small as possible. However, under a high speed engine operation, it is desirable to increase the valve lift and the valve open period so that an adquate intake mixture charge can be provided for high output engine operations.

To comply with such demand, it has already been proposed to provide a plurality of valve actuating cams of different configuration so that one of such cams is selectively used in accordance with the engine operating condition to provide a desired valve operation. For example, Japanese utility model application No. 56-69407 filed on May 15, 1981 and disclosed for public inspection on Nov. 18, 1982 under the disclosure No. 57-182205 discloses a variable valve actuating mechanism including a rocker arm swingable about a rocker shaft and a pair of valve actuating cams, one for high speed engine operation and the other for low speed engine operation. The rocker arm is provided at one end with a first tappet engaging surface which is held in contact with the low speed cam and with a second tappet engaging member for engagement with the high speed cam. The second tappet engaging member is mounted slidably on the rocker arm and a stopper is provided for restricting the sliding movement of the second tappet engaging member when the stopper is in the operative position. In order to move the stopper between the operation position and an inoperative position, an actuator is provided.

It will therefore be understood that, when the stopper is in the inoperative position, the second tappet engaging member is freely slidable so that the low speed cam functions to operate the rocker arm. When the stopper is actuated to the operative position, however, the second tappet engaging member is locked against the slidable movement so that the high speed cam functions to operate the rocker arm to thereby increase the valve lift and the valve open period. It should be noted however that it is unavoidable to provide a certain extent of gap between the second tappet engaging member and the rocker arm in order to allow the aforementioned sliding movement of the second tappet engaging member. Such gap will then produce a sideward play of the second tappet engaging member under a side thrust which will possibly be given by the high speed cam to the second tappet engaging member. Thus, noise may possibly be produced and wear of the sliding surfaces will be accelerated. Further disadvantages in this type of mechanism are that the mechanism is complicated and the inertia of the rocker arm is increased due to the complicated mechanism provided mostly on one end of the rocker arm. Such increase in the inertia of the rocker arm may sometimes cause a jumping of the valve under a high speed engine operation so that the top speed of the engine may have to be decreased.

In the U.S. Pat. No. 4,448,156 which corresponds to the published French patent application No. 2,493,915 and the European patent publication No. 52,554, there is disclosed a valve actuating mechanism including a pair of cams of different shape which are respectively engaged with cam engaging rocker arms swingably mounted on a common rocker shaft. Between the cam engaging rocker arms, there is a valve engaging rocker arm which is mounted at one end swingably on the common rocker shaft. Between the valve engaging rocker arm and the cam engaging rocker arms, there are respectively provided dog clutch devices so that the valve engaging rocker arm is engaged alternately with either one of the cam engaging rocker arms to swing therewith as a unit. The valve engaging rocker arm is mounted on the rocker shaft for slidable movement along the axis of the rocker shaft to be alternately engaged with one of the cam engaging rocker arms. It should however be noted that the mechanism proposed by the U.S. patent is disadvantageous in that the valve engaging rocker arm must be offset with respect to the valve tappet.

A further disadvantage common to the aforementioned known structures is that it is difficult to adjust the valve clearance to a suitable valve for both the low speed and high speed cams.

SUMMARY OF THE INVENTION

It is therefore an object of the present invention to provide an engine valve mechanism in which one or both of the valve lift and the valve open period can be changed with simple and reliable mechanism.

Another object of the present invention is to provide a variable valve mechanism which produces less noise and is durable for a prolonged period of time. A further object of the present invention is to provide a variable valve mechanism which has a rocker arm of a smaller inertia and can provide a smooth valve operation.

Still further object of the present invention is to provide a valve operating mechanism having a plurality of cams for a single valve, in which the valve clearance can be adjusted appropriately for each cam.

According to the present invention, the above and other objects can be accomplished by an engine valve mechanism including a plurality of cams of different shapes which are rotated synchronously with engine rotation, rocker arm means including a plurality of cams engaging rocker arm sections mounted on rocker shaft means for swinging movement and at least one valve engaging rocker arm section mounted on said rocker shaft means for swinging movement, said can engaging rocker arm sections having portions respectively engaged with said cams, said valve engaging rocker arm section having a portion engaged with valve means, connecting means for connecting said valve engaging rocker arm section selectively with one of the cam engaging rocker arm sections, characterized by the fact that one of said valve engaging rocker arm section and said one cam engaging rocker arm section is provided with a locking element which is movable with respect to said one of the valve engaging rocker arm section and the one cam engaging rocker arm section between an operative position wherein said locking element connects said valve engaging rocker arm section with said one cam engaging rocker arm section so that these rocker arm sections are swung as a unit and an inoperative position wherein the locking element disconnect the valve engaging rocker arm section from said one cam engaging rocker arm section, lock means for releasably locking said locking element in said operative position.

With the above arrangements, when the locking element is locked in the operative position, the one cam engaging rocker arm section is operated as a unit with the valve engaging rocker arm section so that the cam which is engaged with the one cam engaging rocker arm section serves to operate the valve. However, when the locking element is in the inoperative position, the one cam engaging rocker arm section becomes freely swingable with respect to the valve engaging rocker arm section so that the cam engaged with the one cam engaging rocker arm section becomes ineffective. According to the present invention, it is possible to locate the locking element and the lock means in the vicinity of the rocker shaft means, so that the inertia of the rocker arm means can be made small.

Valve clearance adjusting means may be provided on the valve engaging rocker arm section and on the portion where the valve engaging arm section is connected with the cam engaging rocker arm section. With this arrangement, it becomes possible to adjust the valve clearance properly for each cam.

The above and other objects and features of the present invention will become apparent from the following descriptions of preferred embodiments taking reference to the accompanying drawings.

DESCRIPTION OF THE PREFERRED EMBODIMENTS

Figure 1:
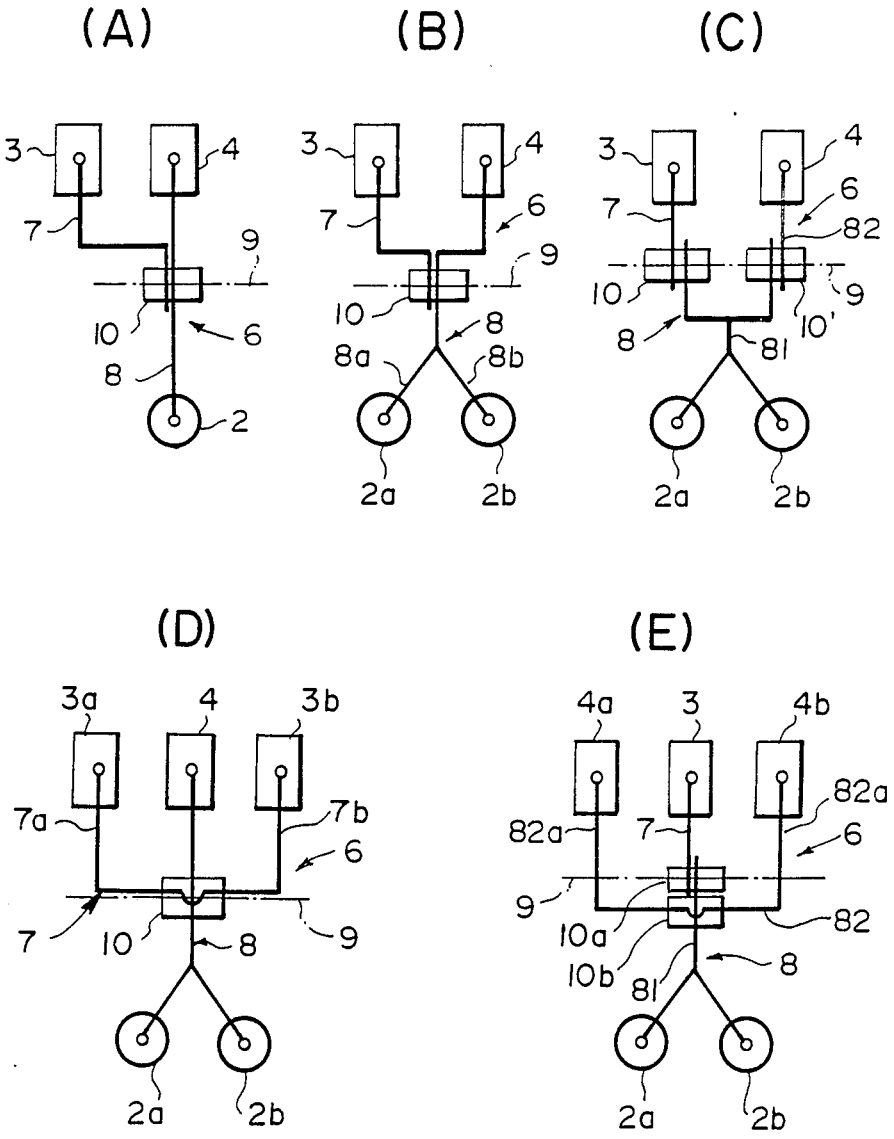
FIGS. 1 (A), (B), (C), (D) and (E) are diagrammatical illustrations of different forms of embodiments.
Figure 2:
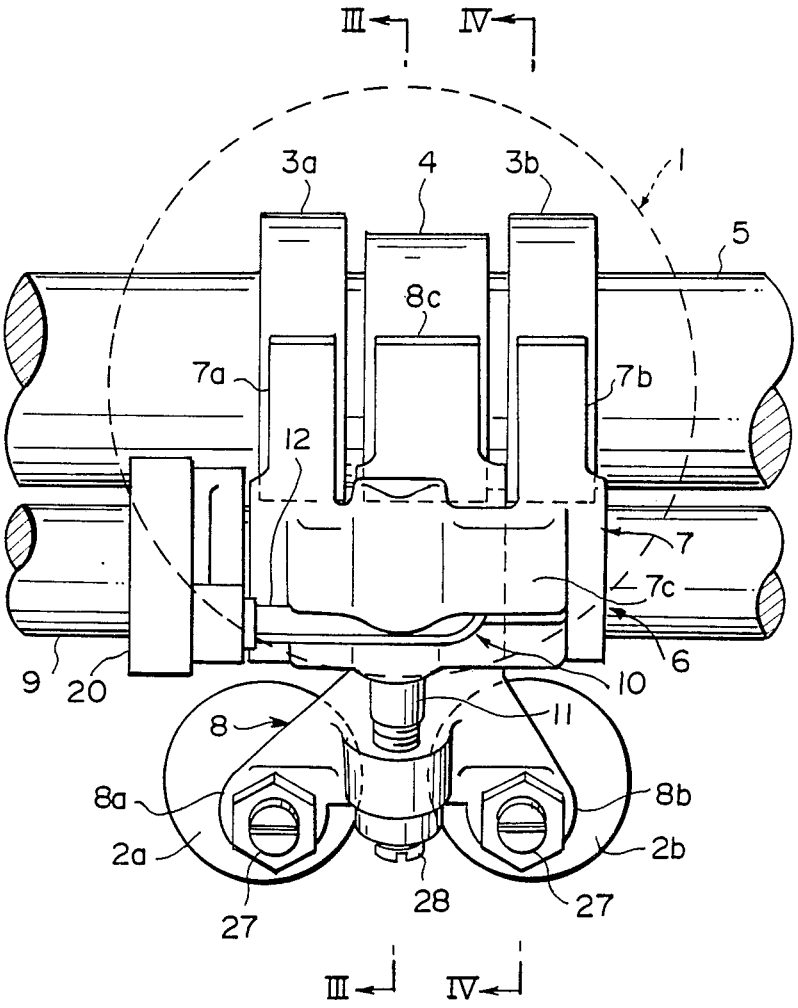
FIG. 2 is a plan view showing the valve operating mechanism in accordance with one embodiment of the present invention.

Referring to the drawings, particularly to FIG. 1(A), there is shown a valve 2 which may be an intake valve or an exhaust valve. For operating the valve 2, there are provided a pair of cams 3 and 4 which are rotationally driven synchronously with the rotation of the engine. The cam 3 may be high speed cam whereas the cam 4 may be a low speed cam. Between the valve 2 and the cams 3 and 4, there is provided a rocker arm mechanism 6 which includes a rocker arm 8 having one end engaged with the valve 2 and the other end engaged with the low speed cam 4. The rocker arm 8 is mounted on a rocker shaft 9 for swinging movement so that the arm 8 is swingably moved by the low speed cam 4 to thereby operate the valve 2. A cam engaging rocker arm 7 is also mounted for swinging movement at one end on the rocker shaft and engaged at the other end with the high speed cam 3. A locking device 10 is provided one of the rocker arms 7 and 8 for releasably connecting the arms 7 and 8 as a unit. When the rocker arms 7 and 8 are connected together, the cam 3 functions to operate the valve 2. The locking device 10 may be actuated appropriately in accordance with the engine operating condition.

Referring to FIG. 1(B), the engine has two valves **2*a* and 2*b* and the rocker arm 8 has two arm ends 8*a* and 8*b* which are engaged respectively with the valves 2*a* and 2*b*. In other respects, the arrangements are the same as that shown in FIG. 1(A). In the arrangements shown in FIGS. 1**(A) and (B), one of the cam engaging rocker arm section is formed integrally with the valve engaging rocker arm section.

Referring to FIG. 1(C), it will be noted that the rocker arm 8 is divided into a valve engaging arm section 81 and a cam engaging arm section 82 which is engaged with the low speed cam 4. The locking device 10 is for connecting the rocker arm 7 to the section 81. A second locking device 10' is provided for connecting the arm section 82 with the arm section 81.

In the arrangement shown in FIG. 1(D), there are provided three cams **3*a*, 3*b* and 4. The rocker arm 8 is engaged on one hand with the valves 2*a* and 2*b* and on the other hand with the cam 4. The rocker arm 7 is divided into arm sections 7*a* and 7*b* which are mounted swingably on the rocker shaft 9 and engaged respectively with the cams 3*a* and 3*b*. In the arrangement shown in FIG. 1(E), there are provided a high speed cam 3 and a pair of low speed cam 4*a* and 4*b*. The rocker arm 8 is separated into an arm section 81 engaged with the valves 2*a* and 2*b* and an arm section 82 having arm ends 82*a* and 82*b* engaged respectively with the cams 4*a* and 4*b*. Locking devices 10*a* and 10*b* are provided for connecting the arm section 81 respectively with the arm section 7 engaged with the cam 3 and the arm section 82 engaged with the cams 4*a* and 4*b***.

Referring now to FIGS. 2 through 5, there is shown an embodiment corresponding to the arrangement shown in FIG. 1(D). The engine in this embodiment includes a pair of intake valves **2*a* and 2*b* and a pair of exhaust valves (not shown) for each cylinder 1. A camshaft 5 is provided and formed with a pair of high speed cams 3*a* and 3*b* of the same shape and low speed cam 4 of a different shape. The cam 4 is located between the cams 3*a* and 3*b*. The high speed cams 3*a* and 3*b* have cam lobes which are larger than the cam lobe in the low speed cam 4 so that the cams 3*a* and 3*b* can provide greater cam lift and cam open period than the cam 4. It should however be noted that the cams 3*a* and 3*b* may be such that one of the cam lift and the valve open period can be increased as compared with the low speed cam 4**.

There is a rocker arm arrangement 6 which includes a cam engaging arm 7 having arm sections **7*a* and 7*b* which are engaged with the high speed cams 3*a* and 3*b*. The rocker arm arrangement 6** further includes a second arm 8 which is bifurcated at one end to provide arm sections 8*a* and 8*b* engaged with the intake valves 2*a* and 2*b*. The arm 8 has at the other end a cam engaging arm section 8*c* which is engaged with the low speed cam 4. As shown in FIG. 1, the arm 8 is located between the arms sections 7*a* and 7*b* of the arm 7. Thus, the arm 7 has a bridge 7*c* which connects the arm sections 7*a* and 7*b* and located to pass over the arm 8. The arms 7 and 8 are swingably mounted on a rocker shaft 9.

In order to releasably connect the arm 7 with the arm 8, there is provided a locking device 10 which includes a plunger 11 received slidably in a cylindrical bore 13 formed in the bridge 7*c* of the arm 7. In the bore 13, there is a coil spring 14 which biases the plunger 11 outwards. An adjust screw 28 is provided on the arm 8 at a position between the valve engaging arm sections 8*a* and 8*b*. The plunger 11 is maintained in an abutting engagement with the adjust screw 28.

Figure 3:
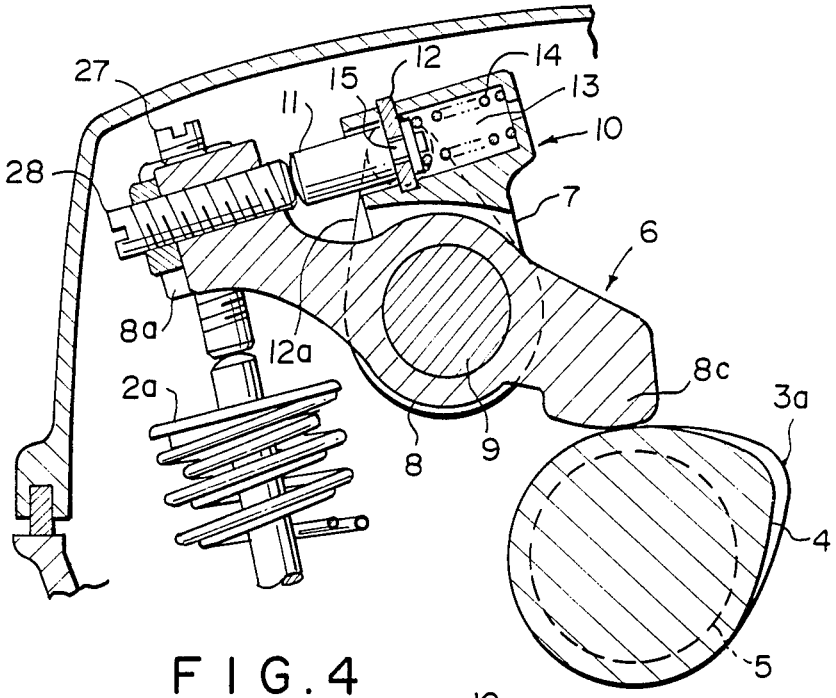
FIG. 3 is a sectional view taken along the line III—III in FIG. 2.
Figure 4:
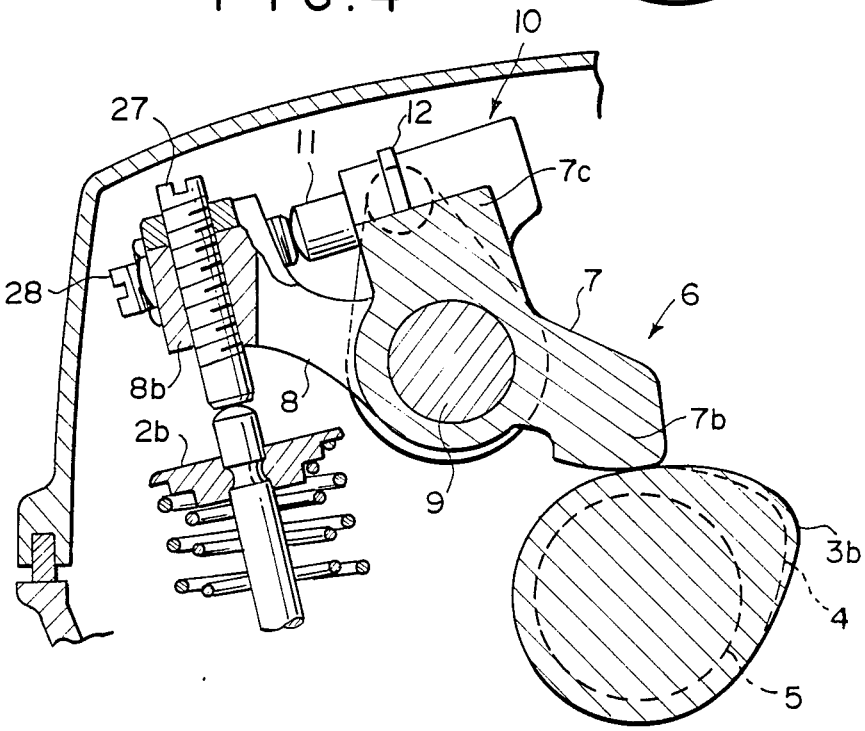
FIG. 4 is a sectional view taken along the line IV—IV in FIG. 2.
Figure 5:
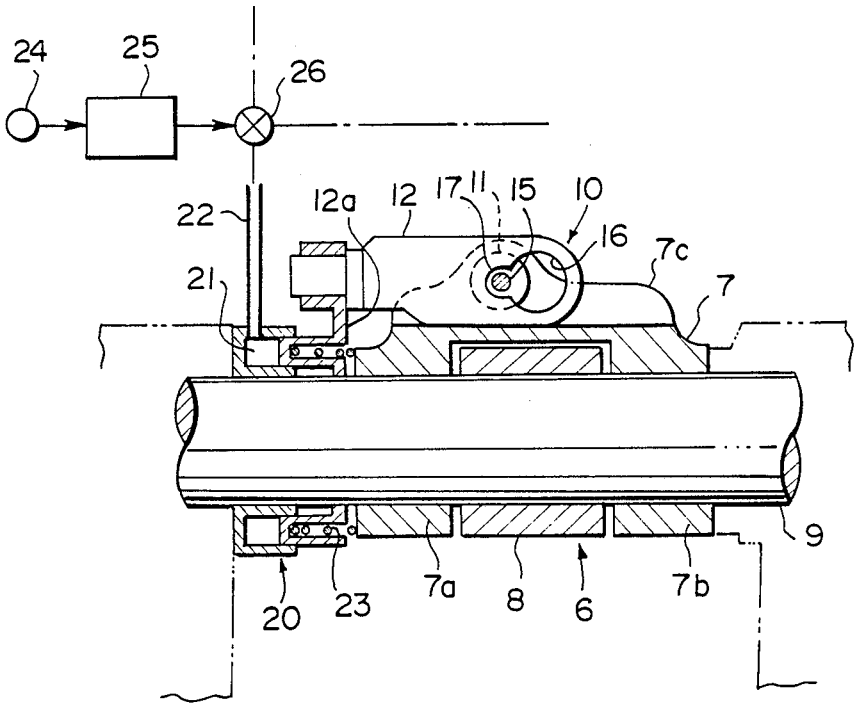
FIG. 5 is a sectional view taken along the rocker shaft.

As shown in FIGS. 3 and 5, the plunger 11 is formed with a small diameter portion 15 and a locking plate 12 is provided for engagement with the small diameter portion 15 of the plunger 11. The locking plate 12 extends in a direction perpendicular to the plunger 11 and formed with a double diameter hole including a large diameter unlocking portion 16 and a small diameter locking portion 17 as shown in FIG. 5. The plunger 11 is passed through the double diameter hole in the locking plate 12. It will be understood that when the plunger 11 passes through the unlocking portion 16 of the hole, the plunger 11 is free to slide in the bore 13 so that the arms 7 and 8 can be swung independently from each other. The valve engaging arm sections 8*a* and 8*b* on the arm 8 are provided with adjust screws 27 which are engaged with the tappets in the valves 2*a* and 2*b* as shown in FIGS. 3 and 4. Therefore, swinging movements produced in the arm 8 are transmitted to the valves 2*a* and 2*b* to operate them. However, swinging movements produced in the arm 7 are not transmitted to the arm 8 so that the valve operations are made only by the low speed cam 4.

When the locking plate 12 is shifted to the position shown in FIG. 5, the locking portion 17 of the hole is engaged with the small diameter portion 15 in the plunger 11 so that the plunger 11 is locked against the axial movement. Thus, the swinging movements of the arm 7 are transmitted to the arm 8 to operate the valves 2*a* and 2*b*. The valves 2*a* and 2*b* are therefore operated by the high speed cams 3*a* and 3*b*.

In order to move the locking plate between the locking and unlocking positions, there is provided an actuator 20 which includes a cylinder 21 and a piston 12*a* which is slidable in the cylinder 21 and connected with the locking plate 12. A conduit 22 is connected with the cylinder 21 to supply a hydraulic pressure through a control valve 26. The control valve 26 is controlled in accordance with the engine speed. For the purpose, there is an engine speed detector 24 having an output connected with a control circuit 25. The control circuit 25 produces an output when the engine speed is beyond a predetermined valve to actuate the control valve 26 so that the hydraulic pressure is supplied to the cylinder 21. The pressure in the cylinder 21 forces the piston 12*a* rightward in FIG. 5 to thereby shift the plate 12 to the locking position. A return spring 23 is provided to force the piston 12*a* leftward in FIG. 5 so that the piston 12*a* and the locking plates 12 are moved to the unlocking position. It will of course be noted that any type of actuator can be used for moving the locking plate 12.

The arrangements described above are advantageous in that the plunger 11 is subjected only to axially directed forces so that it is unlikely that a lateral play is produced in the movement of the plunger 11. Further, the locking device 10 is located in the vicinity of the rocker shaft 9 so that the inertia of the rocker arm arrangement 6. In FIG. 5, it will be noted that the actuator 20 is formed separately from the rocker arms and mounted on the rocker shaft 9. This arrangement is effective to further decrease the weight and the inertia of the rocker arms. In this embodiment, the valve clearance for the low speed cam 4 can be adjusted by the adjust screw 27 on the arm sections 8*a* and 8*b*. The valve clearance for the high speed cams 3*a* and 3*b* can be adjusted by the adjust screw 28.

Figure 6:
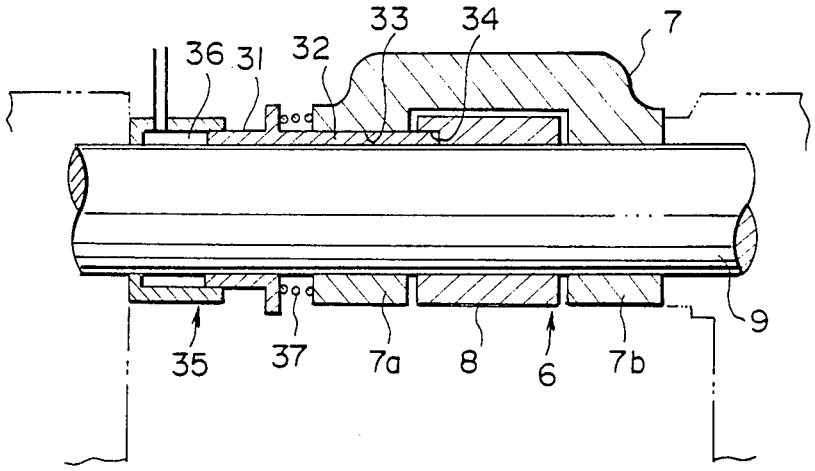
FIG. 6 is a sectional view similar to FIG. 5 but showing another example of the locking device.
Figure 7:
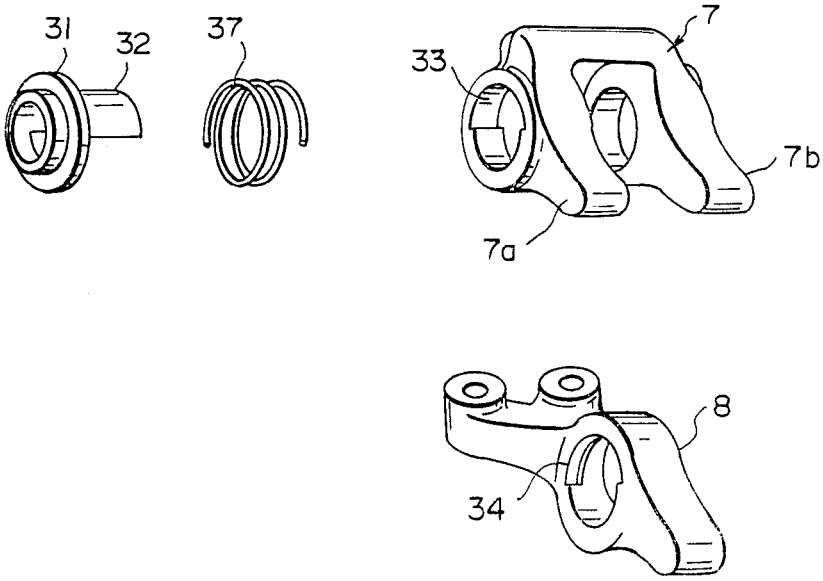
FIG. 7 is an exploded perspective view of the locking device shown in FIG. 6.

Referring to FIGS. 6 and 7, there is shown another embodiment of the locking device. In this embodiment, there is provided a plunger 31 which is mounted axially slidably on the rocker shaft 9 and has an axially extending pawl 32. The arm 7 is formed with a groove 33 which is slidably engaged with the pawl 32. The arm 8 is also formed with a groove 34 with which the pawl 32 is adapted to be engaged. The plunger 31 is actuated by an actuator 35 including a cylinder 36 to a position shown in FIG. 6 wherein the pawl 32 is engaged both the grooves 33 and 34 in the arms 7 and 8 to lock the arm 7 on the arm 8. A return spring 37 is provided to force the plunger 31 leftward in FIG. 6 so that the plunger 31 is shifted leftward when the pressure in the cylinder 36 is relieved to thereby retract the pawl 32 from the groove 34.

Figure 8:
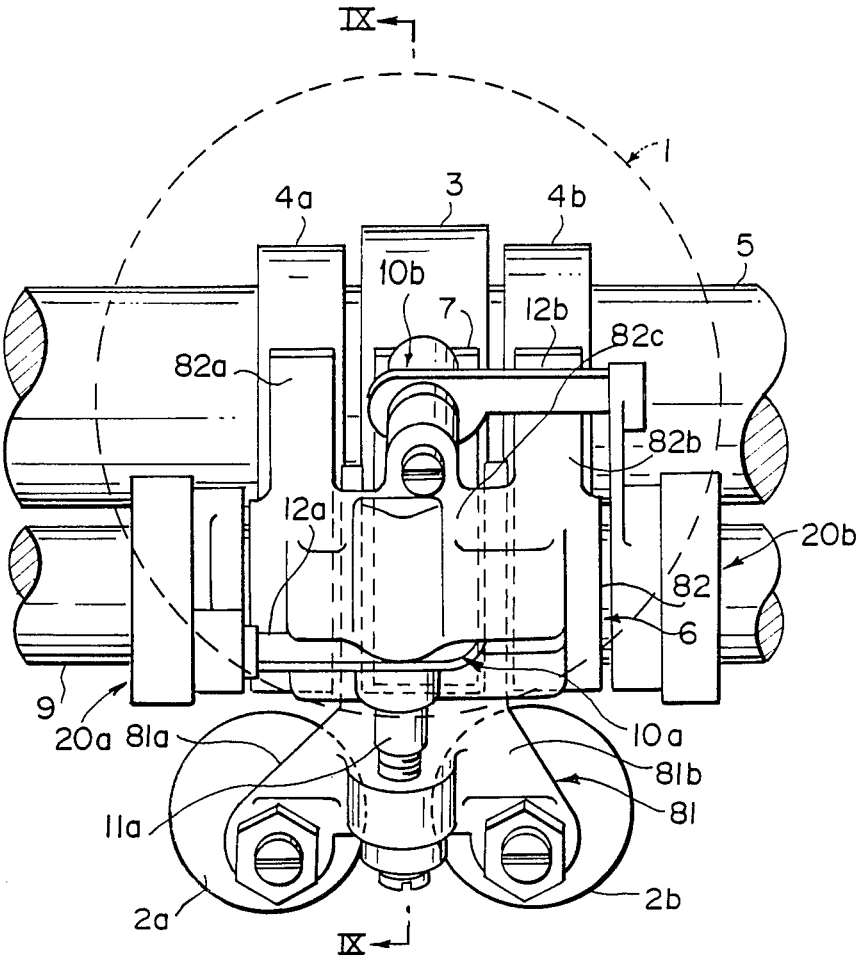
FIG. 8 is a plan view showing another embodiment of the present invention.
Figure 9:
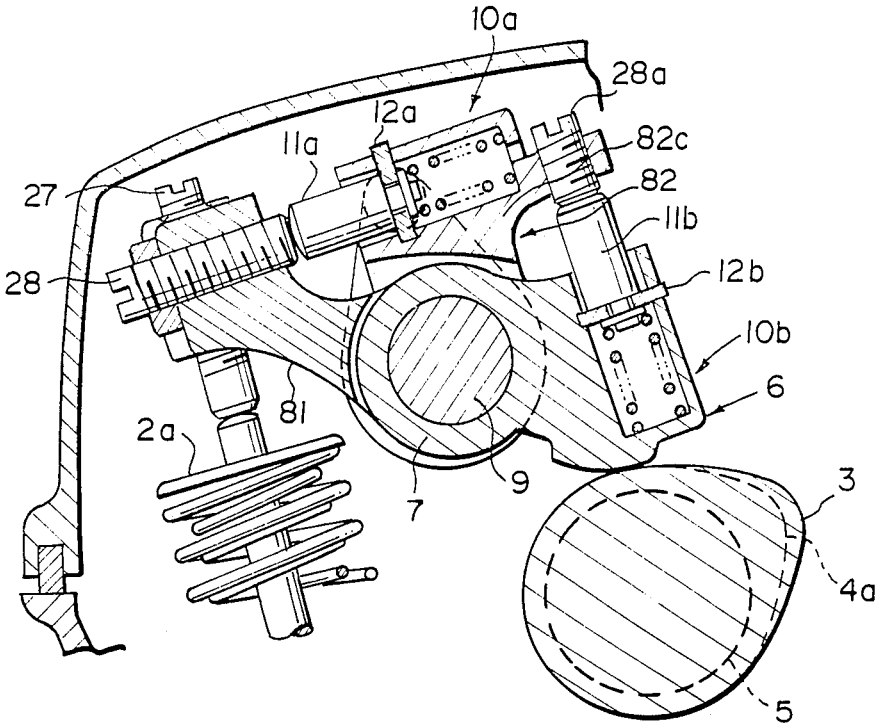
FIG. 9 is a sectional view taken along the line IX—IX in FIG. 8.
Figure 10:
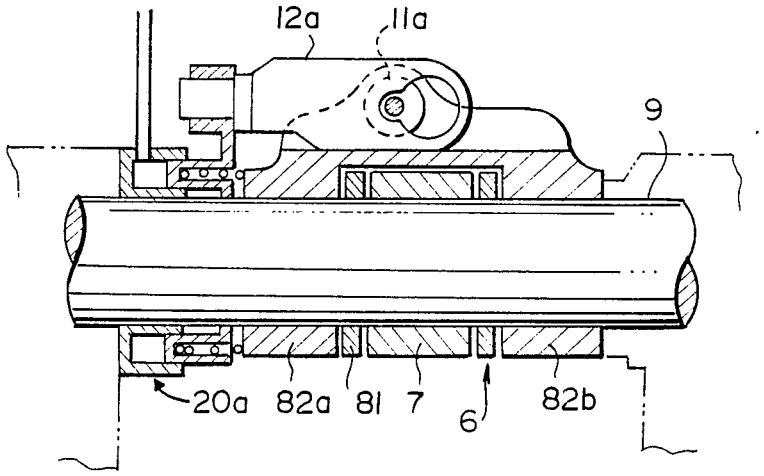
FIG. 10 is a sectional view taken along the rocker shaft in the embodiment shown in FIG. 8.

Referring now to FIGS. 8 through 10, the embodiment shown therein corresponds to the arrangement shown in FIG. 1(E). In this embodiment, the cam shaft 5 is formed with a pair of spaced apart low speed cams 4*a* and 4*b* and a high speed cam 3 located between the cams 4*a* and 4*b*. The rocker arm arrangement 6 includes a cam engaging arm 7 which is engaged with the high speed cam 3 and a cam engaging arm 82 having a pair of arm sections 82*a* and 82*b* engaged with the low speed cams 4*a* and 4*b*, respectively. The arrangement 6 further includes a valve engaging arm 81 having a pair of arm sections 81*a* and 81*b* engaged with the valves 2*a* and 2*b*, respectively.

The arms 7, 81 and 82 are mounted swingably on a rocker shaft 9. The arm 82 has a bridge 82*c* connecting together the arm sections 82*a* and 82*b*, and a locking device 10*a* which is identical to the locking device 10 of the embodiment shown in FIGS. 1 through 5 is provided on the bridge 82*c* for locking the arm 82 on the arm 81. A second locking device 10*b* which is similar to the locking device 10*a* is provided on the arm 7. The locking device 10*b* has a plunger 11*b* which is in an abutting engagement with an adjust screw 28*a* on the arm 82 so that, by actuating the locking plate 12*b* into the locking position, the arm 7 is locked on the arm 82. It will therefore be understood that, when only the locking device 10*a* is in the locking position, the valves 2*a* and 2*b* are operated by the low speed cams 4*a* and 4*b*, however, when both the locking devices 10*a* and 10*b* are in the locking positions, the valves are operated by the high speed cam 3. When the locking devices 10*a* and 10*b* are released, the valves 2*a* and 2*b* are made inoperative. The valve clearance is adjusted by the adjust screws 27, 28 and 28*a*.

The invention has thus been shown and described with reference to specific embodiments, however, it should be noted that the invention is in no way limited to the details of the illustrated structures but changes and modifications may be made without departing from the scope of the appended claims.

We claim:

1. A valve mechanism for an internal combustion engine including a plurality of cams of different shapes which are rotated synchronously with engine rotation, rocker arm means including a plurality of cam engaging rocker arm sections mounted on rocker shaft means for swinging movement and at least one valve engaging rocker arm section mounted on said rocker shaft means for swinging movement, said cam engaging rocker arm sections and said at least one valve engaging rocker arm section being unable to move in an axial direction of the rocker shaft means, said cam engaging rocker arm sections having portions respectively engaged with said cams, said valve engaging rocker arm section having a portion engaged with valve means, connecting means for connecting said valve engaging rocker arm section selectively with one of the cam engaging rocker arm sections, characterized by the fact that one of said valve engaging rocker arm section and said one cam engaging rocker arm section is provided with a locking element which is movable with respect to said one of the valve engaging rocker arm section and the one cam engaging rocker arm section between an operative position wherein said locking element connects said valve engaging rocker arm section with said one cam engaging rocker arm section so that these rocker arm sections are swung as a unit and an inoperative position wherein the locking element disconnects the valve engaging rocker arm section from said one cam engaging rocker arm section, lock means for releasably locking said locking element in said operative position.

2. A valve mechansim in accordance with claim 1 in which said valve engaging rocker arm section is formed integrally with another cam engaging rocker arm section.

3. A valve mechanism in accordance with claim 2 in which the cam with which said one cam engaging rocker arm section is engaged is so shaped that it provides a greater valve open period that the cam with which other cam engaging rocker arm section is engaged.

4. A valve mechanism in accordance with claim 3 in which means is provided for operating the lock means under an engine speed greater than a predetermined valve.

5. A valve mechanism in accordance with claim 1 in which said locking element is in the form of a plunger axially slidably mounted on said one of said valve engaging rocker arm section and said one cam engaging rocker arm section, the other of said valve engaging rocker arm section and said one cam engaging rocker arm section being provided with abutting means which is in abutting engagement with the plunger, said operative position being defined by a projected position of the plunger, said lock means including means for restraining said plunger in the projected position.

6. A valve mechanism in accordance with claim 5 in which said last mentioned means is a locking plate movable perpendicularly to the plunger.

7. A valve mechanism in accordance with claim 5 in which said last mentioned means is a locking plate movable perpendicularly to the plunger, hydraulic actuator means being provided for actuating the locking plate.

8. A valve mechanism in accordance with claim 5 in which said abutting means is an adjusting screw, a second adjusting screw being provided between said valve engaging rocker arm section and said valve means.

9. A valve mechanism in accordance with claim 1 in which said valve means include two valves, said valve engaging rocker arm section having two arm portions engaged respectively with the valves.

10. A valve mechanism in accordance with claim 1 which includes adjusting means provided between said valve engaging rocker arm section and said one cam engaging rocker arm section for adjusting a relative position therebetween.

11. A valve mechanism in accordance with claim 1 which includes second locking means for connecting another cam engaging rocker arm section with said valve engaging rocker arm section.

12. A valve mechanism in accordance with claim 1 which includes second locking means for connecting another cam engaging rocker arm section with said one cam engaging rocker arm section.

13. A valve mechanism in accordance with claim 1 in which said locking element is a pawl member axially slidably mounted on the rocker shaft means for engagement with grooves formed in said cam engaging rocker arm means and said valve engaging rocker arm sections.

14. A valve mechanism in accordance with claim 13 in which said grooves are formed at a side with respect to said rocker shaft means opposite to the side where the arm sections are engaged with the cams and the valve means.

15. A valve mechanism for an internal combustion engine including a first cam providing a first valve lift, a second cam providing a second valve lift which is larger than the first valve lift, a first rocker arm swingably mounted on a rocker shaft and having one end engaged with said first cam and the other end engaged with valve means, a second rocker arm swingably mounted on the rocker shaft and having one end engaged with said second cam, a plunger mounted on said second rocker arm for movement axially between a projected position and a retracted position, abutting means provided on said first rocker arm for an abutting engagement with the plunger, said abutting means including an adjustable screw which has an end for the abutting engagement with the plunger, valve clearance adjusting means between said first rocker arm and said valve means, a locking plate provided on said second rocker arm for movement perpendicularly to said plunger and having means for engagement with said plunger to restrain the movement of the plunger, drive means for driving the locking plate, control means responsive to engine speed and operating the drive means to make the locking plate restrain the movement of the plungers to thereby lock the second rocker arm on the first rocker arm.

16. A valve mechanism for an internal combustion engine including a first cam providing a first valve lift, a second cam providing a second valve lift which is larger than the first valve lift, a first rocker arm swingably mounted on a rocker shaft and having one end engaged with said first cam, a second rocker arm swingably mounted on the rocker shaft and having one end engaged with said second cam, a third rocker arm swingably mounted on the rocker shaft and engaged with valve means, a first plunger mounted on one of said first and second rocker arms for movement axially between a projected position and a retracted position, first abutting means provided on the other of said first and second rocker arms for an abutting engagement with the first plunger, first locking means for locking said first plunger in the projected position, a second plunger mounted on one of the first and third rocker arm for movement axially between a projected position and a retracted position, second abutting means provided on the other of said first an third rocker arms for an abutting engagement with the second plunger, second locking means for locking the second plunger in the projected position, drive means for selectively operating said first and second locking means, valve clearance adjusting means provided at least two portions between first through third rocker arms and the valve means.

17. A valve mechanism for an internal combustion engine including a first cam providing a first valve lift, a second cam providing a second valve lift which is larger than the first valve lift, a first rocker arm swingably mounted on a rocker shaft and having one end engaged with said first cam and the other end engaged with valve means, a second rocker arm swingably mounted on the rocker shaft and having one end engaged with said second cam, a cylindrical member mounted on the rocker shaft for axial slidable movement, said cylindrical member having an axially extending pawl, said first and second rocker arms being provided with grooves for engagement with the pawl, actuating means for moving the cylindrical member between a locking position wherein the pawl is engaged with the grooves in both of the first and second rocker arms and a release position wherein the pawl is disengaged at least from one of the grooves, control means responsive to engine speed and operating the actuating means to drive the cylindrical member into the locking position when the engine speed is beyond a predetermined value.

* * * * *